United States Patent [19]

Sukup

[11] Patent Number: 4,579,102

[45] Date of Patent: Apr. 1, 1986

[54] BIOMASS HEAT EXCHANGER FURNACE

[76] Inventor: Eugene G. Sukup, Beeds Lake, Hampton, Iowa 50441

[21] Appl. No.: 596,265

[22] Filed: Apr. 3, 1984

Related U.S. Application Data

[62] Division of Ser. No. 484,981, Apr. 14, 1983, Pat. No. 4,449,510.

[51] Int. Cl.[4] ..... F24H 3/00

[52] U.S. Cl. ..... 126/99 A; 126/109; 165/158; 165/176

[58] Field of Search ..... 110/101 R, 275, 276; 126/99 R, 99 A, 102, 103, 109, 111, 114; 165/172-176, 157, 158, 164, D12, 145, D2; 237/55

[56] References Cited

U.S. PATENT DOCUMENTS

| | | | |
|---|---|---|---|
| Re. 5,871 | 5/1874 | Twitchell | 126/99 |
| 212,963 | 4/1879 | McCaw | 126/61 |
| 424,035 | 3/1890 | Sweetland | 126/99 R |
| 451,962 | 5/1891 | Walker | 126/99 R |
| 529,090 | 11/1894 | Wiegand | 126/99 R |
| 566,450 | 8/1896 | Edgar | 126/99 D |
| 1,132,875 | 3/1915 | Pemberton | 126/99 R |
| 1,323,305 | 2/1919 | Monaghan | 126/99 R |
| 1,436,297 | 11/1922 | Spallone | 126/99 R |
| 1,604,833 | 10/1926 | Lindsay | 126/99 R |
| 1,891,996 | 12/1932 | Miller | 126/99 A |
| 2,075,485 | 3/1937 | Turner | 126/77 |
| 2,113,607 | 4/1938 | Upton | 165/159 |
| 2,288,028 | 6/1942 | Richardson | 126/99 |
| 2,357,831 | 9/1944 | Judy | 126/99 R |
| 4,093,022 | 6/1978 | Polyak | 165/157 |
| 4,217,878 | 8/1980 | Wieweck | 126/110 R |
| 4,261,326 | 4/1981 | Ihlenfield | 126/99 D |
| 4,286,570 | 9/1981 | Kuosmanen | 126/99 R |
| 4,312,321 | 1/1982 | Skow | 126/99 A |
| 4,319,557 | 3/1982 | Sietmann | 126/110 R |

FOREIGN PATENT DOCUMENTS

| | | | |
|---|---|---|---|
| 55147 | 5/1890 | Fed. Rep. of Germany | 126/99 A |
| 241045 | 10/1909 | Fed. Rep. of Germany | 126/99 |
| 11139 | 4/1854 | France | 126/99 A |
| 81208 | 6/1868 | France | 126/99 |
| 84427 | 2/1869 | France | 126/99 |
| 600455 | 11/1925 | France | 126/99 A |
| 615934 | 10/1926 | France | 126/99 |

OTHER PUBLICATIONS

Sukup Biomaster, Crop Residue Drying System, 4 pages.

Vortex Furnace Schematic, 6-1979, Thomas R. Miles.

*Primary Examiner*—Samuel Scott

*Assistant Examiner*—Noah Kamen

*Attorney, Agent, or Firm*—Neuman, Williams, Anderson & Olson

[57] ABSTRACT

A hot air heat exchanger furnace that uses crop residue as a fuel source is provided for producing the heat required for various purposes, such as the drying of grains, peanuts, soybeans and other materials and for the heating of buildings. The furnace includes a combustion chamber, an upper manifold, a lower manifold, a plenum and a number of exhaust tubes. The exhaust tubes direct the flow of combustion gases from the combustion chamber in a serpentine path in the plenum between the upper and lower manifolds and into a stack. Meanwhile, ambient air passes into the plenum, past the heat transfer surfaces of the combustion chamber and the exhaust tubes as heat transfers to it. Then it passes out of the furnace.

9 Claims, 6 Drawing Figures

Fig. 1
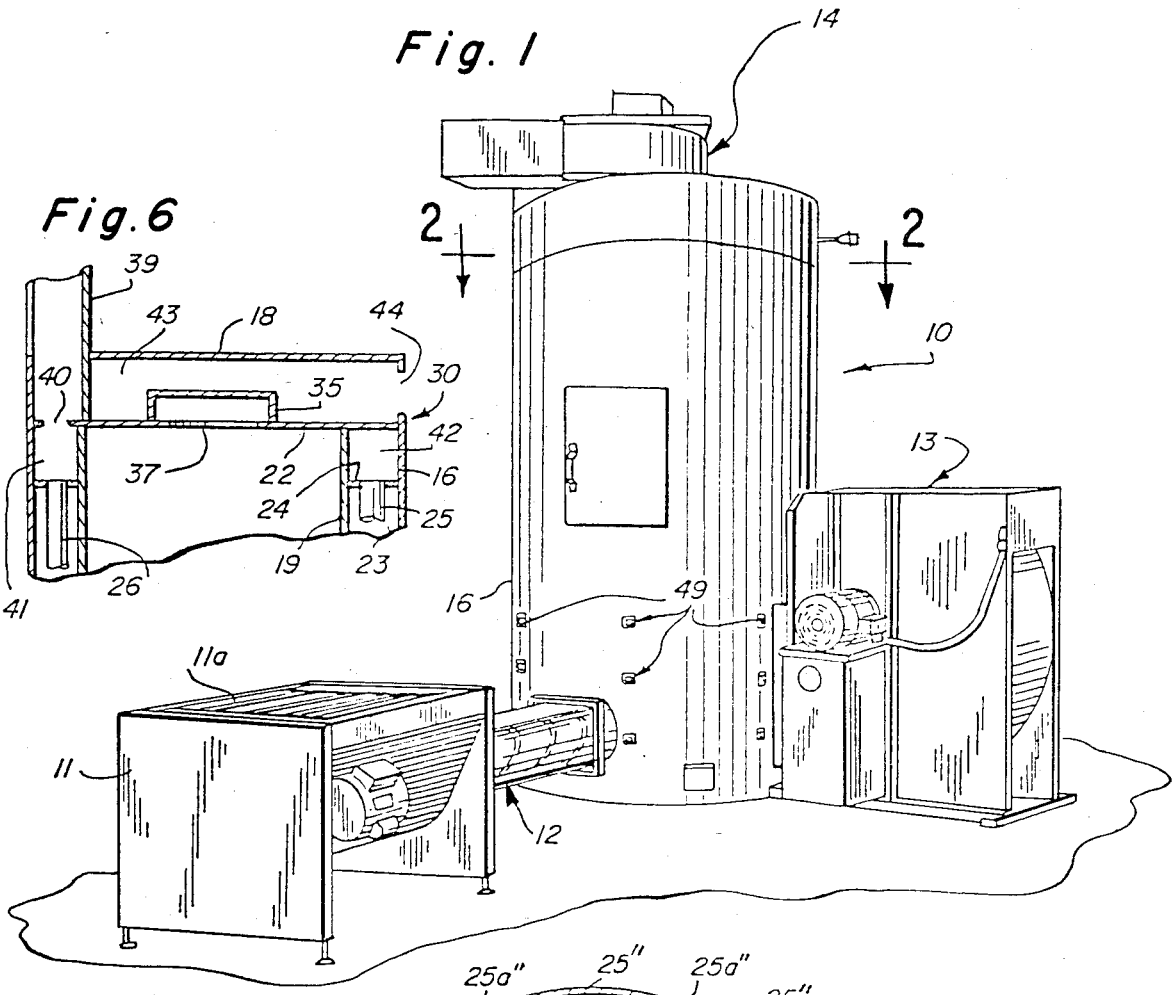
Fig. 6
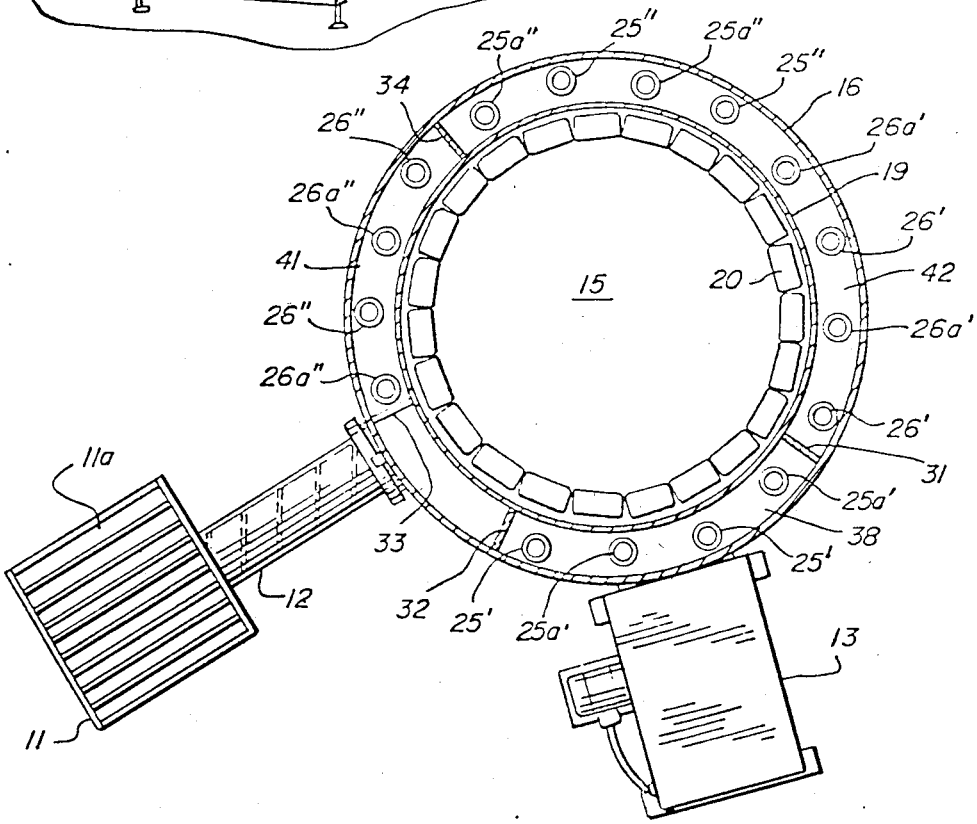
Fig. 2

BIOMASS HEAT EXCHANGER FURNACE

This application is a division of application Ser. No. 484,981 filed Apr. 14, 1983 for a "Biomass Heat Exchange", now U.S. Pat. No. 4,449,510.

BACKGROUND OF THE INVENTION

1. Field of the Invention

This invention relates to hot air heat exchanger furnaces, and more particularly to a hot air heat exchanger furnace that use biomass (crop residue) as a fuel source.

2. Background

It has been found that use of biomass (crop residue) as a source of fuel for various heating demands is highly desirable because of its renewability, accessibility, low cost, and its substantial BTU content. For example, in many grain farming operations involving the raising of corn and the like, it has been the common practice during harvesting to allow the crop residue such as stalks and associated parts thereof, as well as the cobs where shelling of the corn occurs in the field, to remain in the field to assist in controlling soil erosion and to effect partial replenishment of various soil nutrients and organic content for subsequent plantings. However, all such residue is not required for these purposes. In some instances, e.g., where the residue is accumulated at a processing point, such as peanut shells at a shelling plant, disposal of the residue is a problem. Moreover, in some areas, crop residue is burned in the field for disposal. Because of the substantial costs of conventional fuels (i.e., oil, natural gas, propane, etc.), it has been found that such crop residue could be utilized as a fuel for producing the heat required for various purposes, such as the drying of grains, peanuts, soybeans and other materials and for the heating of buildings. The furnace illustrated and described herein is useful in such applications.

It is desirable that hot air heat exchanger furnaces have characteristics that increase operating efficiency and reduce heat loss. These characteristics include: a combustion chamber with a large radiating surface; long exhaust tubes placed within the furnace to constrain the combustion gases and pass them over the large radiating surface of these tubes; and an arrangement of components that restricts the movement of the air through the furnace, allowing it to come into close association with the heat radiating surfaces. It is also desirable that these furnaces be of a simple, rugged and inexpensive design. The furnace illustrated and described herein has all of these characteristics.

OBJECTS OF THE INVENTION

It is a general object of this invention to provide an improved hot air heat exchanger furnace with the characteristics noted above.

Accordingly, it is an object of the present invention to provide an improved, low cost, and simplified hot air heat exchanger furnace which will have a high operating efficiency and which will minimize heat loss.

It is yet another object of this invention to provide a hot air heat exchanger furnace that constrains combustion gases in the furnace long enough to minimize energy loss, that has a large heat exchange surface area to improve transfer of heat to the air and that restricts the movement of the air through the furnace, allowing it to come into close association with the heat radiating surface.

Other objects, advantages and features of the present invention will become apparent upon reading the following detailed description and appended claims, and upon reference to the accompanying drawing.

SUMMARY OF THE INVENTION

In accordance with one embodiment, a heat exchanger furnace of the present invention includes a housing, a cylindrical combustion chamber disposed within the housing and a plurality of exhaust tubes arranged in a circumferentially spaced and radially staggered relation within an annular cylindrical plenum formed between the combustion chamber and the interior surface of the surrounding housing. The ends of the tubes communicate with manifolds provided at the upper and lower ends of the combustion chamber. The exhaust tubes direct the flow of the combustion gases along sinuous or serpentine paths between the upper and lower manifolds. The top and side walls of the furnace housing and a baffle positioned at the top of the plenum coact to form the upper manifold with a plurality of contiguous compartments. The bottom and side walls of the furnace housing and a baffle positioned at the bottom of the plenum define the lower manifold with a plurality of contiguous compartments. Exhaust gases rise in the combustion chamber and flow into a first compartment of the upper manifold. A first set of exhaust tubes extend from this chamber to a first compartment of the lower manifold and enable the hot combustion gases to flow downwardly to the first compartment of the lower manifold. A second set of tubes connect this first lower chamber with a second chamber in the upper manifold and convey the gases upward to this second chamber. A third set of tubes connect the second chamber in the upper manifold with a second chamber in the lower manifold and again convey the exhaust gases downward to the lower manifold. A fourth set of tubes connect the second chamber in the lower manifold with a third chamber in the upper manifold and convey the exhaust gases upward to this third chamber. This third chamber communicates with a stack through which these gases are discharged into the atmosphere. A blower impels ambient air into the annular plenum through an opening at the bottom of the furnace. This air moves through the plenum, in a spiral serpentine path around the combustion chamber and across the exhaust tubes to gain heat, and exits through an opening in the upper manifold at the top of the furnace. A vertical partition in the plenum defines this flow path.

A DETAILED DESCRIPTION OF AN EMBODIMENT OF THE INVENTION

For a more complete understanding of this invention, reference should now be made to the embodiment illustrated in greater detail in the accompanying drawings and described below by way of an example of the invention.

In the drawings:

FIG. 1 is a perspective view of one embodiment of the improved biomass heat exchanger furnace shown in combination with a fuel hopper, a fuel conveyor connecting the hopper with the furnace and a blower assembly for the fresh or ambient air to be heated;

FIG. 2 is an enlarged fragmentary top cross-sectional view of the furnace taken on the line 2—2 in FIG. 1;

FIG. 6 is a partial sectional view through the upper manifold portion of the furnace of FIG. 1, taken generally along vertical radial planes through the stack and the heated air outlet.

Figure 3:
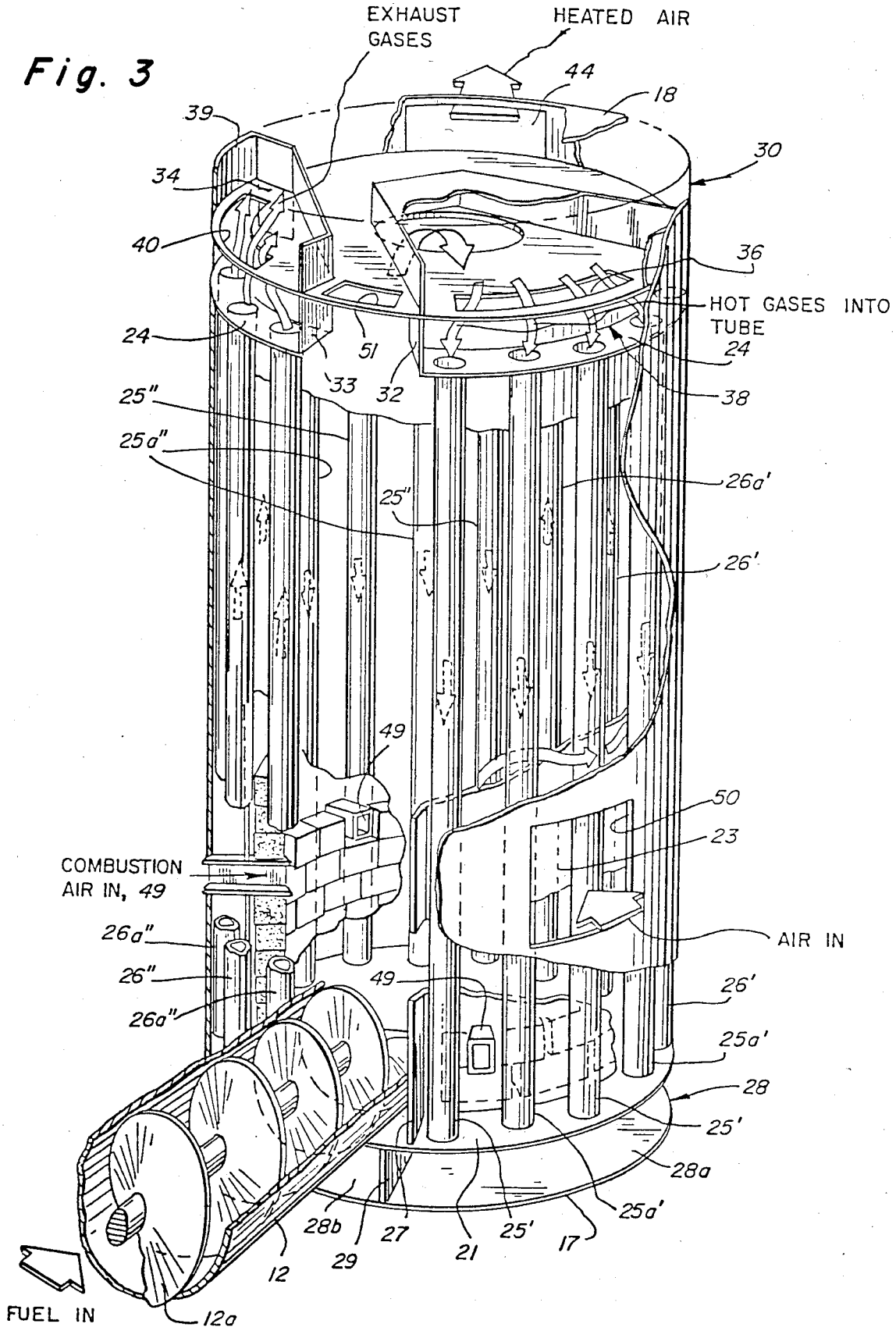
FIG. 3 is an enlarged fragmentary perspective view of the furnace with portions thereof broken away and some parts in phantom so as to expose the interior construction thereof.

It should be understood, of course, that the invention is not necessarily limited to the particular embodiment illustrated herein.

DETAILED DESCRIPTION OF THE DRAWINGS

Turning first to FIGS. 1 and 2, a preferred embodiment of the improved biomass heat exchange furnace 10 is shown in combination with a biomass fuel hopper 11 and a conveyor 12 connecting the hopper 11 to the furnace 10. A conventional centrifugal impeller blower 13 is mounted in spaced relation with respect to the hopper and forces ambient or fresh air into the furnace. Another centrifugal fan 14 is mounted on the top of the furnace for exhausting the combustion gases generated within the furnace. The hopper 11 has an open top 11*a* for loading therein biomass fuel, such as corn stalks, cobs, or the like. The fuel material is removed from the bottom of the hopper through the housing of conveyor 12 in which is disposed a power-driven conventional auger 12*a* which feeds the biomass into a combustion chamber 15 formed within the interior of furnace 10. Upwardly curved fingers at the inner end of the conveyor (not shown) in the combustion chamber tend to cause the fuel material to well upward in the combustion zone.

Figure 5:
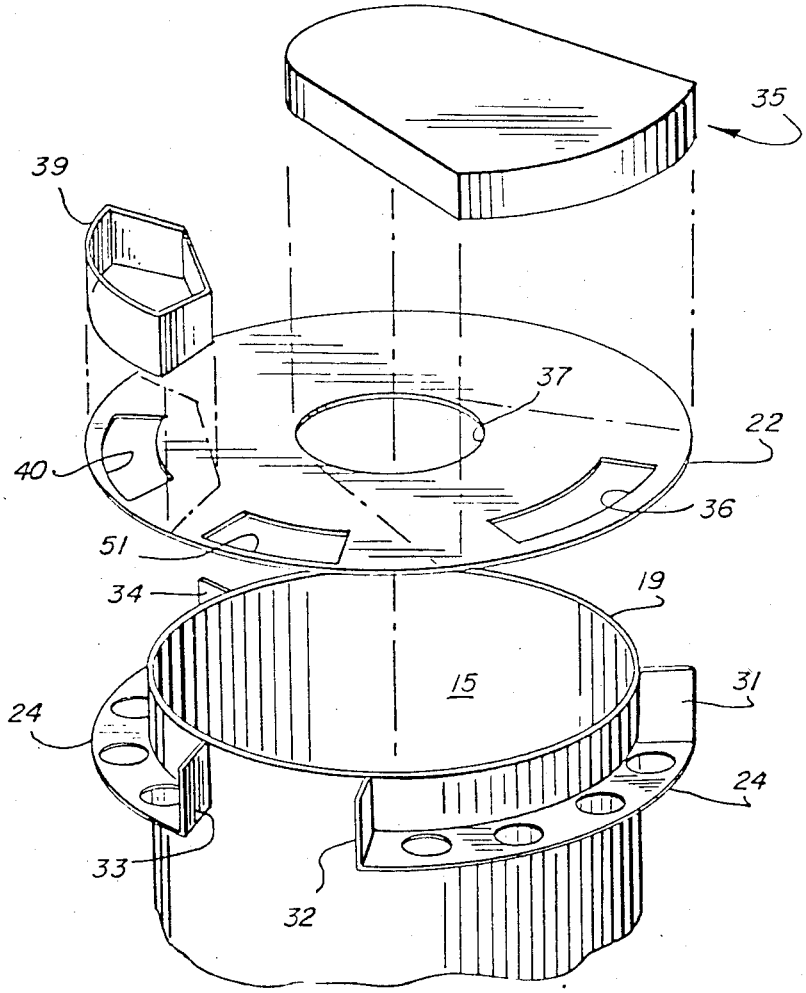
FIG. 5 is an enlarged fragmentary perspective view of the top portion of the heat exchanger furnace showing various components thereof in exploded relation.

The furnace 10 includes a cylindrical external housing 16 supported in an upright position by a circular base 17. The upper end of the housing 16 is provided with a circular top closure plate 18. Disposed within housing 16 is the combustion chamber 15 which is provided with an outer cylindrical housing 19 having the inner surface thereof lined with suitable fire brick 20 in the combustion zone or fire pot. The bottom of chamber 15 is defined by the base 17 and the upper end of the chamber is capped by a top plate 22, see FIGS. 3, 5 and 6. Plates 17 and 22 are preferably of flat circular configurations with the diameters thereof equal to the inner diameter of furnace housing 16 and are connected to the housing by welding or the like.

The furnace 10 is provided with a heating air plenum chamber 23 which is formed between the inner surface of the housing 16 and the outer or exterior surface of the combustion chamber housing 19. A lower annular baffle plate 21 and a top annular baffle 24 extend between the housings 16 and 19 and define, respectively, the bottom and top extremeties of the plenum chamber 23, see FIG. 3. The outside diameter of each of these baffles 31 and 24 is substantially equal to the inside diameter of furnace housing 16 and the inside diameter thereof is substantially equal to the outside diameter of combustion chamber housing 19, and is joined thereto, as by welding. Plenum chamber 23 has disposed therein a plurality of vertically oriented tubes 25, 25*a*, 26, 26*a* arranged in circumferentially spaced and radially staggered relation. The ends of the tubes are attached to top and bottom ringlike baffles 21 and 24. By reason of the staggered relation, tubes 25 and 26 form an annular row having a diameter which is less than the diameter of the annular row formed by tubes 25*a* and 26*a*. Tubes 25 and 25*a* carry downflowing combustion gases; tubes 26 and 26*a* carry upflowing combustion gases. A vertical partition 27, shown in FIG. 3, extends radially across the plenum chamber 23 from the top baffle 24 to the bottom baffle plate 21.

The heat exchanger furnace 10 also includes a bottom manifold 28 and a top manifold 30. The bottom baffle plate 21 and base 17 together with the bottom portion of the furnace housing 16 define the bottom manifold 28. Radial partitions 29 (FIG. 3) divide manifold 28 into two contiguous compartments, namely compartment 28*a* and compartment 28*b*.

The outer cylindrical furnace housing 16, the upper end portion of combustion chamber housing 19, top baffle 24, top plate 22, and the top plate 18 of the furnace housing define the top manifold 30. A number of partitions in top manifold 30 divide it into four contiguous compartments 38, 41, 42 and 43. These partitions include laterally spaced vertical partitions 31, 32, 33 and 34, each extending between combustion chamber housing 19, outer housing 16, top baffle 24 and top plate 22. Partitions 31 and 32 delimit compartment 38. A conduit-forming cap 35 mounted on plate 22 over openings 36 and 37 in plate 22 directs combustion gases from the outlet 36 of the combustion chamber into this compartment 38 of the top manifold 30. Partitions 33 and 34 delimit compartment 41 which communicates with a stack 39 mounted on plate 22 over opening 40 in plate 22. Partitions 31 and 34, the bottom surface of plate 22 and baffle 24 define compartment 42. Partitions 32 and 33, the upper surface of top plate 22, along with the outer surfaces of stack 39 and cap 35, and the respective portions of housing 16 and 19, and top plate 18 define compartment 43. An opening 51 is provided through plate 22 within this compartment 43. An opening 44 is provided in furnace housing 16 for conveying the heated air from compartment 43 to the outside of the furnace, and maybe connected to a heating duct system.

Exhaust tubes connect the compartments of the top manifold with those of the bottom manifold. As shown, exhaust tubes 25, 25*a*, 26 and 26*a* connect compartments 38, 41 and 42 of top manifold 30 with bottom compartments 28*a* and 28*b* of manifold 28 through openings 45, 45*a*, 46 and 46*a* in top baffle 24 and openings 47, 47*a*, 48 and 48*a* in bottom baffle plate 21. These tubes extend vertically through the plenum chamber 23, and are arranged in circumferentially spaced and radially staggered array therearound as best seen in FIG. 2. An opening 50 in furnace housing 16 (FIG. 3) allows fresh unheated air to flow into plenum chamber 23, e.g., from the blower 13, for heat exchange contact with these exhaust tubes therein.

Combustion air inlet tubes 49 extend through furnace housing 16 and combustion chamber housing 19, and through the fire brick lining 20, connecting the lower portion or firebox of the combustion chamber with the outside of the furnace. These tubes preferably are at an angle to radii of the furnace to insure swirling movement of the air in the combustion chamber.

During operation of furnace 10, hopper 11 feeds biomass fuel material to the conveyor 12. Auger 12*a* moves the material into the combustion chamber 15. The material burns in the combustion chamber 15, with the combustion air entering through air passages 49 and being drawn through the furnace and heat exchanger by the blower 14. The combustion gases flow upward in the combustion chamber 15 and exit at the top of the chamber through the opening 37 in plate 22 and enter the compartment 38 of the top manifold 30.

Figure 4:
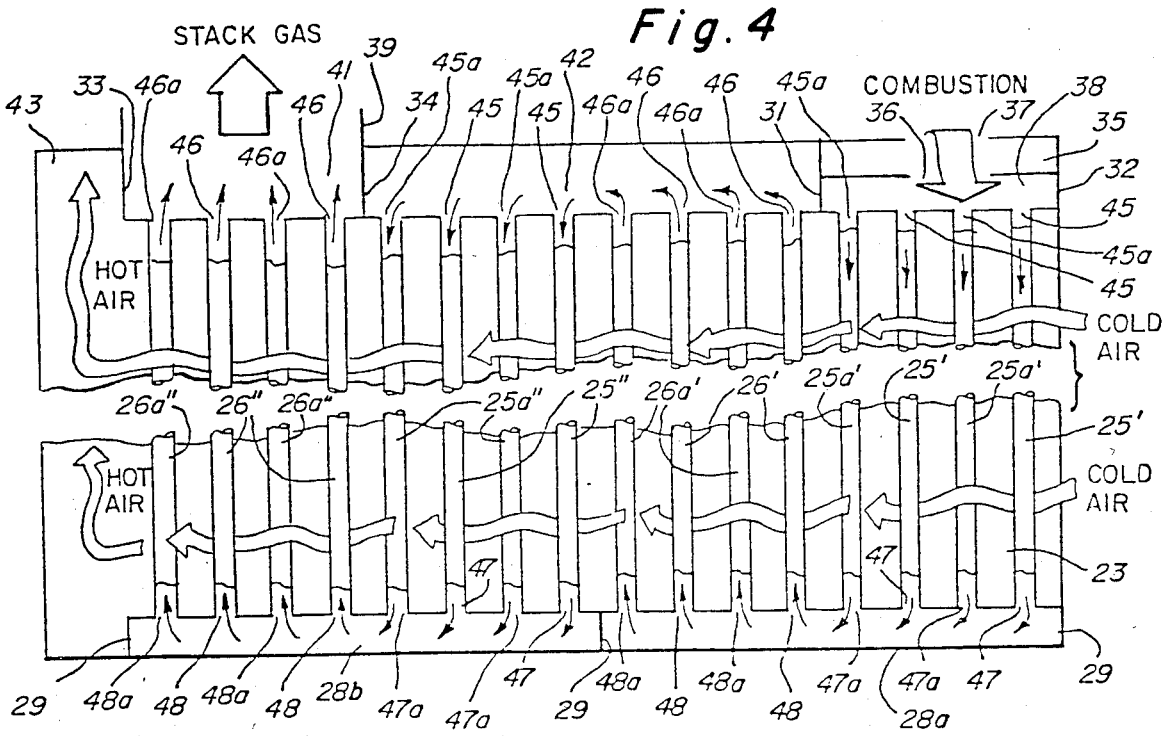
FIG. 4 is a schematic diagram of the furnace.

As can be seen schematically in FIG. 4, from the compartment 38 the combustion gases flow into the first set of exhaust tubes 25' and 25a' which communicate with that compartment and provide down flow passages for the gases. Moving down through tubes 25' and 25a' the gases enter the chamber 28a of the lower manifold 28 through outlets 47 and 47a. These gases then flow into up-flow exhaust tubes 26' and 26a' through inlets 48 and 48a. They move up through tubes 26' and 26a' and into the compartment 42 through outlets 46 and 46a in the top baffle 24. After entering compartment 42 the gases flow into the second set of downflow exhaust tubes 25'' and 25a'' through inlets 45 and 45a in the top baffle 24. They flow down the tubes 25'' and 25a'' and into chamber 28b of lower manifold 28 through outlets 47 and 47a in the lower baffle 21. From chamber 28b, the gases flow up into the second set of up-flow exhaust tubes 26'' and 26a'' through inlets 48 and 48a, and from those tubes into compartment 41 of upper manifold 30 and into stack 39 and axially into the centrifugal blower 14 from which they are discharged to the atmosphere.

Meanwhile, the electric blower 13 forces fresh ambient air through air inlet opening 50 into furnace housing 16 adjacent to partition 27 and a short distance above manifold 28. This air enters plenum 23 and flows therearound in a sinuous path across the exhaust tubes. The arrangement of down-flow exhaust tubes 25 and 25a and up-flow exhaust tubes 26 and 26a in plenum 23 consists of laterally spacing tubes 25 and 26 along one radius and laterally spacing tubes 25a and 26a along a slightly lesser radius, with all tubes spaced from the chamber walls 16 and 19. The spacing between combustion chamber housing 19 and exhaust tubes 25a and 26a placed along the shorter of the two radii is small, but tubes 25a and 26a do not come into contact with combustion chamber housing 19. The spacing between furnace housing 16 and exhaust tubes 25 and 26 placed along the greater of the two radii is also small, but tubes 25 and 26 do not come into contact with furnace housing 16. Because of this arrangement, the forced air flow follows a generally sinuous path around exhaust tubes 25, 25a, 26 and 26a and contacts the peripheral surface of each tube. The air primarily flows along the side of the tubes 25 and 26 facing combustion chamber housing 19, and along the side of the tubes 25a and 26a facing furnace housing 16.

As the air flows around plenum 23, exhaust tubes 25, 25a, 26 and 26a and combustion chamber housing 19 transfer heat to it, and the air rises. Partition 27 prescribes the circumferential flow path for the air from the air inlet 50 around the combustion chamber 15 and to the outlet compartment 43. The heated air flows up and into top manifold 30 between partitions 32 and 33. It then flows through opening 51 in plate 22, over plate 22 and out through opening 44 in cylindrical shell 16. As the air flows through compartment 43, additional heat transfers to the air from plate 22, cap 35 and stack 39.

Thus, a hot air heat exchanger furnace has been provided that is of simple yet effective and rugged construction and that is inexpensive to manufacture. Yet, it is capable of operating efficiently by minimizing heat loss during its operation.

Whereas a preferred embodiment of the invention has been shown and described herein, it will be apparent that many modifications, alterations and variations may be made by and will occur to those skilled in the art to which this invention pertains, particularly upon considering the foregoing teachings. It is, therefore, contemplated by the appended claims to cover any such modification and other embodiments as incorporate those features which constitute the essential features of this invention within the true spirit and scope of the following claims.

What is claimed is:

1. A heat exchanger furnace comprising a first upright cylindrical housing; a second upright cylindrical housing disposed within said first housing and defining a combustion chamber having an inlet for fuel and an outlet for combustion gases generated within said combustion chamber; a plenum chamber formed between said first and second housings and having a top and a bottom; a first manifold having plural compartments and disposed adjacent the top of said plenum chamber and said second housing and having a first compartment thereof communicating with said outlet; a second manifold having plural compartments and disposed adjacent the bottom of said plenum chamber and said second housing; an inlet formed in said first housing and communicating with said plenum chamber for admitting a gaseous fluid; an outlet formed in said first housing and communicating with said plenum chamber and spaced substantially from said inlet for the gaseous fluid; means for circulating the gaseous fluid through said plenum chamber; means defining at least four sets of passageways for the combustion gases disposed within said plenum chamber and interconnecting corresponding compartments within said first and second manifolds for four successive passages of the combustion gases between said manifolds through said plenum chamber whereby the combustion gases flow successively between the corresponding compartments of said first and second manifolds and are in heat exchange relation with the gaseous fluid circulating through said plenum chamber; vent means formed in said first housing and in communication with said passageways whereby the combustion gases are discharged from the furnace subsequent to having successively flowed through the corresponding compartments of said manifolds and said passageways; and means for causing said combustion gases to flow through said manifolds, conduits and vent means.

2. The heat exchanger furnace of claim 1 wherein said passageway means are thermally conductive tubes arranged in laterally spaced relation between said first and second housings.

3. The heat exchanger furnace of claim 2 wherein said tubes are arranged so as to form two substantially concentric rows.

4. The heat exchanger furnace of claim 3 wherein the tubes forming one row are in staggered relation with respect to the tubes forming the second row.

5. The heat exchanger furnace of claim 2 wherein the tubes are arranged in spaced substantially parallel relation.

6. The heat exchanger furnace of claim 2 wherein said tubes have substantially the same internal dimension.

7. The heat exchange furnace of claim 1 wherein said means for causing said combustion gases to flow comprises exhaust blower means for drawing such gases through such manifolds and passageways.

8. The heat exchanger furnace of claim 2,3,4,5 or 6 wherein said tubes are substantially straight and vertically disposed thin walled structures.

9. The heat exchanger furnace of claim 1 or 7 wherein said passageway means are thermally conductive tubes arranged in laterally spaced relation between said first and second housing, said tubes being substantially straight and vertically disposed thin walled structures.

* * * * *